United States Patent [19]

Kim

[11] Patent Number: 4,581,963

[45] Date of Patent: Apr. 15, 1986

[54] SCREW HOLDING DEVICE FOR SCREWDRIVERS

[76] Inventor: Han K. Kim, 83-45 Vietor Ave., Elmhurst, N.Y. 11375

[21] Appl. No.: 751,516

[22] Filed: Jul. 3, 1985

[51] Int. Cl.[4] ..... B25B 23/08

[52] U.S. Cl. ..... 81/452; 81/454; 81/458

[58] Field of Search ..... 81/452, 451, 458, 454

[56] References Cited

U.S. PATENT DOCUMENTS

| | | | |
|---|---|---|---|
| 1,450,203 | 4/1923 | De Brown | 81/452 |
| 1,549,413 | 8/1925 | Greet . | |
| 2,028,546 | 1/1936 | John . | |
| 2,406,952 | 9/1946 | Josepho . | |
| 2,633,168 | 3/1953 | Mahaffey . | |
| 2,780,257 | 2/1957 | Duggan . | |
| 2,954,809 | 10/1960 | Loewy . | |
| 3,115,168 | 12/1963 | Acres . | |
| 3,245,446 | 4/1966 | Morifuji . | |
| 3,361,169 | 1/1968 | Charchenko . | |
| 4,221,249 | 9/1980 | Mazzeo et al. | 81/451 |

*Primary Examiner*—Frederick R. Schmidt
*Assistant Examiner*—J. T. Zatarga
*Attorney, Agent, or Firm*—Charles E. Temko

[57] ABSTRACT

A plurality of devices are disclosed for supporting threaded screws in a plane normal to a surface into which the screws are threaded. Each embodiment includes means for supporting the shank of the screw at points intermediate the ends thereof rather than only at the head thereof. The means is resiliently expandable to permit passage of the head of the screw past the supporting means for disengagement of the device after the screw has obtained substantial threaded purchase with an engaged structure.

2 Claims, 5 Drawing Figures

SCREW HOLDING DEVICE FOR SCREWDRIVERS

BACKGROUND OF THE INVENTION

This invention relates generally to the field of hand tools, and more particularly to an improved form of screw holding device engaged with a conventional screwdriver to facilitate the installation of screws in areas of limited access often using only a single hand of the user. Devices of this general type are known in the art, and the invention lies in specific constructional details which permit improved operation due to superior support for the screw as it is driven.

The great bulk of the prior art usually includes the provision of a pair of resilient fingers adapted to grasp the screw at the underlying surface of the head. The fingers are carried by a sleeve in turn carried by the shank portion of the screwdriver and frictionally retained thereon. Typical of such structure is the disclosure in U.S. Pat. No. 1,426,320 to Reid.

Naugle et al., Pat. No. 1,512,706 granted Oct. 21, 1924 discloses the structure of a screw supporting sleeve which is threadedly engaged with a corresponding thread on the screwdriver shank. The driven screw is supported only at the head thereof.

Greet, Pat. No. 1,549,413 discloses a resilient metallic stamping which engages the under surface of the head of a screw, and a short segment of the threaded shank disposed immediately therebeneath. It employs the under surface of the head of the screw to spread the resilient sleeve to release the screw as it nears the position of full seating. This is also the case in Josepho Pat. No. 2,406,952 of Sept. 3, 1946.

Duggan, U.S. Pat. No. 2,780,257 of Feb. 5, 1957 employs a pair of tubular coaxially arranged members, an outer one of which is used to tense an inner one as the screw is driven to full seating. Actual engagement of the screw is by the head portion only, although the inner tubular member surrounds at least part of the shank of the screw as well without contacting the same.

Lowry, Pat. No. 2,954,809 of Oct. 4, 1960, discloses a clamping device of sleeve type in which the broadened blade of the screwdriver is used to open the clamp.

SUMMARY OF THE INVENTION

Briefly stated, the invention contemplates the provision of an improved screw holder for screwdrivers in which the sliding sheath or sleeve which surrounds the screwdriver shank is so configured as to support the engaged screw at a medial portion of the threaded shank, rather than the head portion. The sleeve is of hollow cylindrical configuration having an inner diameter sufficient to permit relative rotation of the widest portion of the screwdriver blade. Adjacent the distal end of the sleeve is a portion of diameter corresponding to the outer diameter of the shank of a screw to be driven, the extreme distal end of the sleeve being substantially the same diameter as that of the proximal end. The medially positioned portion is lifted to form a plurality of resiliently expandable ribs, anchored at both ends thereof, to enable the portion to ride over the enlarged head of the screw as the screw is seated.

As compared with the prior art, there is no need to interconnect the sleeve to the screwdriver shank, except for purposes of storage when not in use. The device is "loaded" by dropping a screw into the proximal end of the sleeve, so that it may drop under the action of gravity to a point where the threaded shank is inserted thereinto to come to rest with the threaded shank supported by the resiliently expandable ribs in coaxial relation to the axis of the sleeve. Upon insertion of the screwdriver, the kerf of the screw is readily engaged, and driving of the screw may proceed without the possibility of the screw shank buckling under pressure from the screwdriver as purchase is obtained. When the previously engaged threaded shank has been substantially engaged within the work, the head of the screw forces the resilient ribs to laterally expand to permit passage of the head thereby so that the screw may be fully seated.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 2:
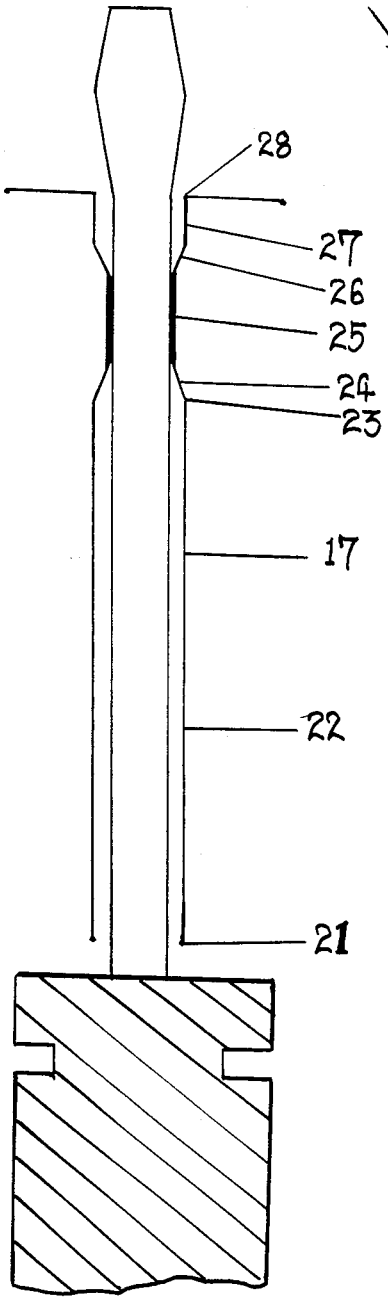
FIG. 2 is a schematic view of the structure shown in FIG. 1, showing certain of the component parts in altered relative position.

In accordance with the first embodiment of the invention, generally indicated by reference character 10 (FIGS. 1 and 2) a conventional screwdriver 11 including a handle portion 12 and a cylindrical shank 13 includes a distal end 14 having a screwdriver bit 15. It will be understood by those skilled in the art that the flat bit may be replaced by a so-called Phillips driving bit at the end thereof, if desired, for use with a corresponding screw head.

Surrounding the screwdriver shank is an elongated sleeve 17 of synthetic resinous material such as polypropylene, or the like, or mildly tempered metallic materials, such as a mild steel or brass. The sleeve includes a first proximal end 21 leading to a first cylindrical portion 22, a lower end 23 of which leads to a tapered portion 24. The tapered portion 24 communicates with a relatively narrow cylindrical portion 25 which terminates in a flared portion 26 leading to a lower cylindrical portion 27 of diameter corresponding to that of the portion 22. The portion 27 terminates in a distal second end 28.

Figure 1:
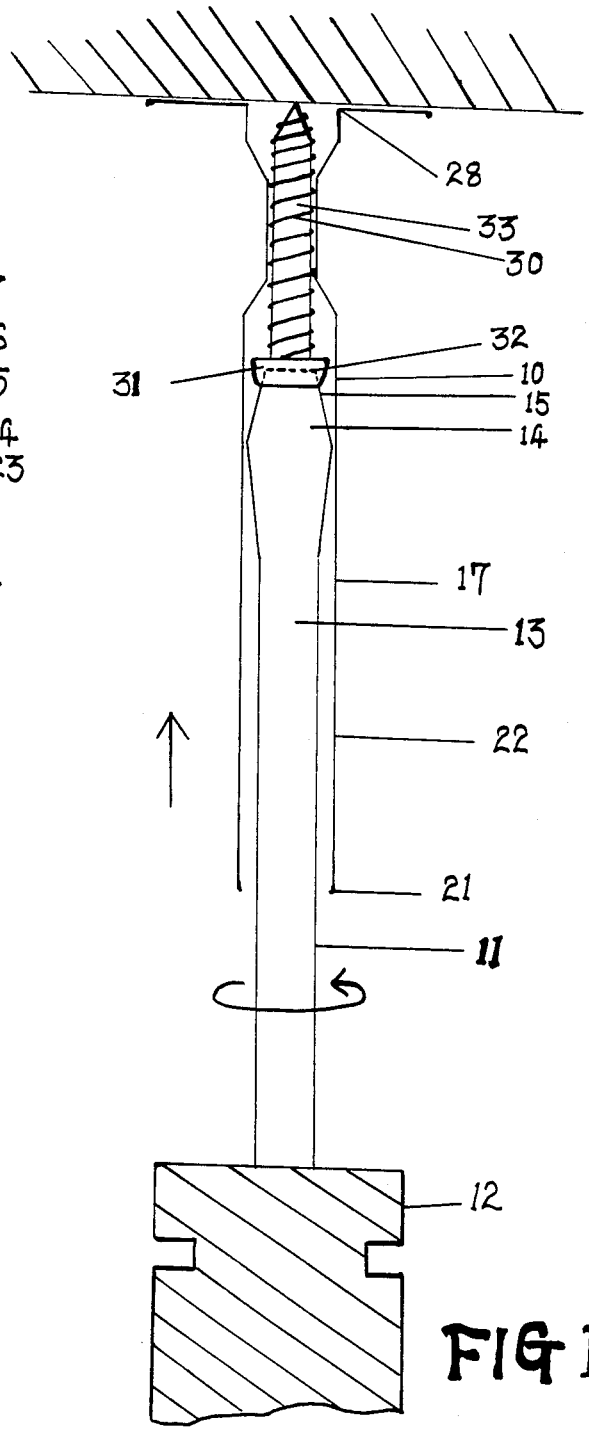
FIG. 1 is a schematic view of a first embodiment of the invention.
Figure 3:
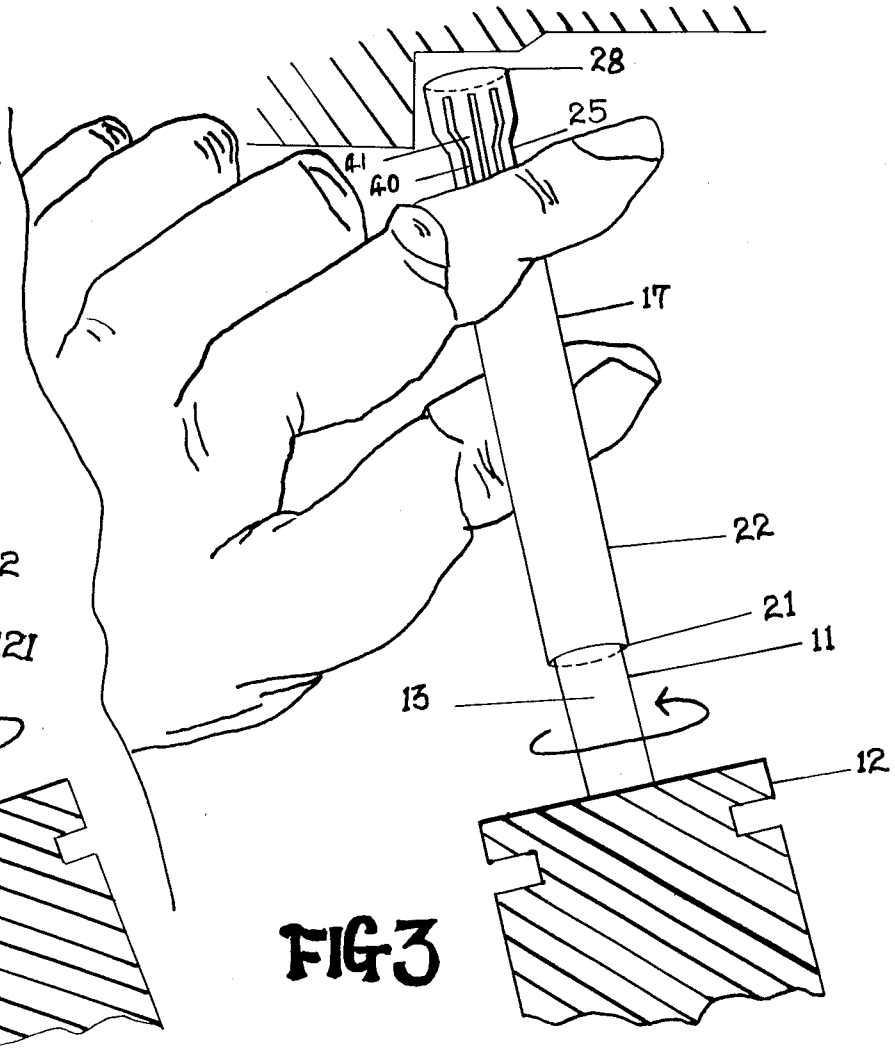
FIG. 3 is a fragmentary view in perspective showing the positioning of the first embodiment for use.

In use, a sized screw 30 includes a head portion 31 and the usual kerf 32 which corresponds in diameter to that of the portion 22. The threaded shank 33 thereof corresponds in outer diameter to the inner diameter of the portion 25, so that when positioned as shown in FIG. 1 in the drawing, the axis of the screw is maintained in coaxial relation relative to the axis of the device at least until the screw has substantial purchase in the material with which it is engaged.

The portion 25 is provided with radially arranged longitudinal slots 40 thus forming a plurality of elongated resilient ribs 41 therebetween.

During operation, the screwdriver engages the kerf in the screw head while the same is disposed in the portion 22. With the distal end 28 placed in abutting relation to the surface of the material with which the screw is to be engaged, rotation of screw will advance the threaded shank to a portion where the undersurface of the head 31 will press against the tapered portion 24 and thus spread the ribs 41 to permit the head to pass thereby. When the head is nearly fully seated, and is in the lower cylindrical portion 27, the resilience of the tabs will return the narrow cylindrical portion 25 to its original configuration.

Figure 4:
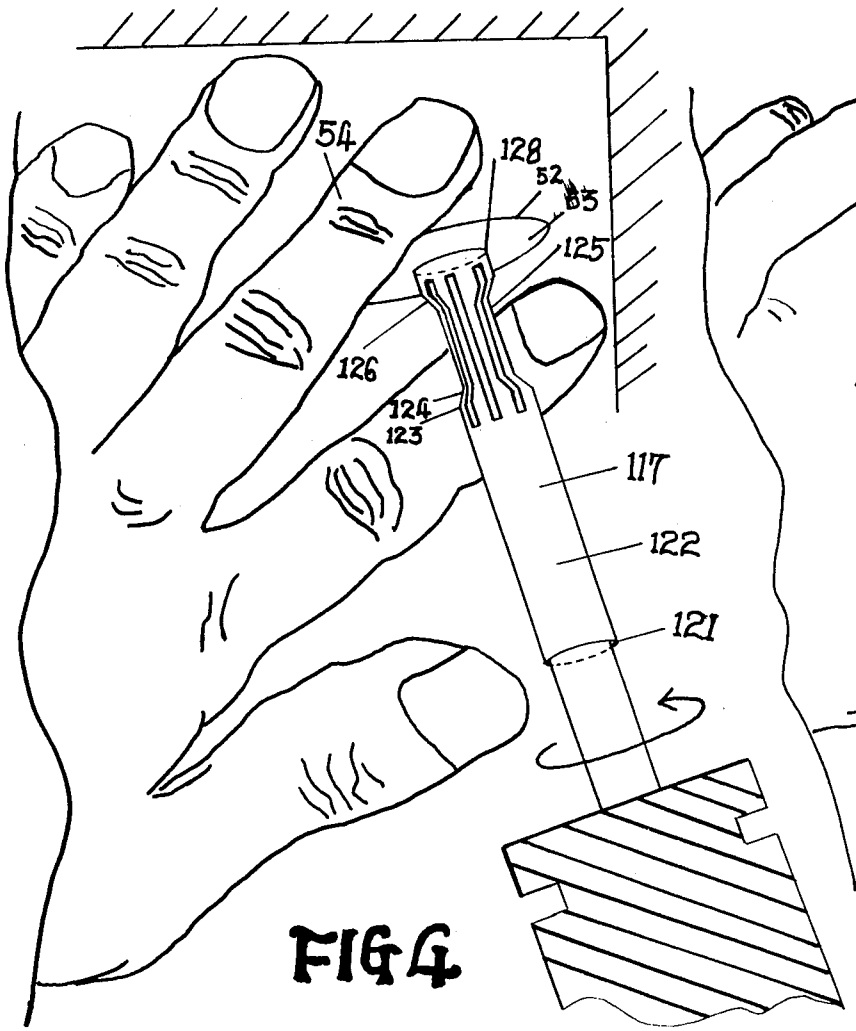
FIG. 4 is a fragmentary view similar to that seen in FIG. 3, showing a second embodiment of the invention.

Turning now to the second embodiment of the invention illustrated in FIG. 4, parts corresponding to those of the principal embodiment have been designated by similar reference characters, with the additional prefix "1".

This embodiment differs from the principal embodiment in the provision of a radially extending distal flange 52, an inner surface 53 of which can be engaged by the fingers 54 of a user to hold the device in position when starting the threading action of a screw.

Figure 5:
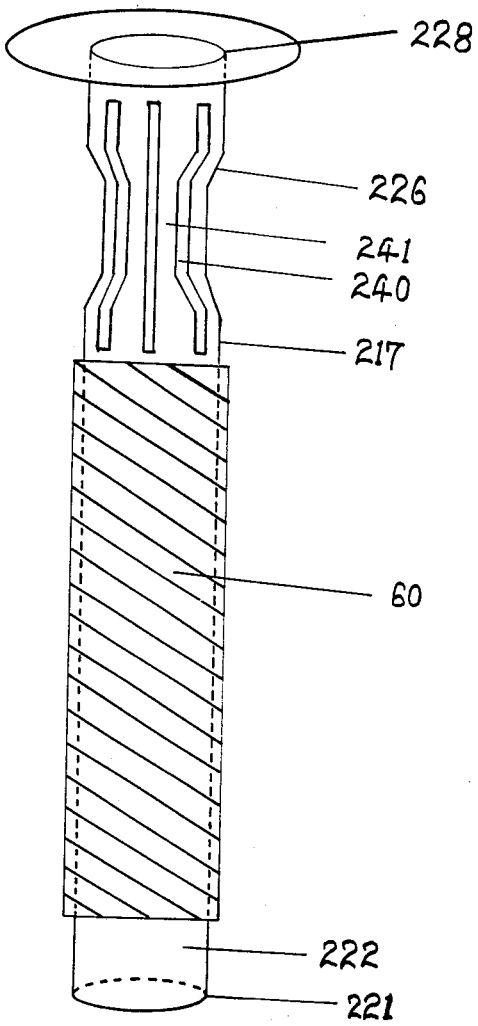
FIG. 5 is a view in perspective showing a third embodiment of the invention.

Turning now to the embodiment shown in FIG. 5, parts corresponding to those of the principal embodiment have been designated by corresponding parts with the additional prefix "2".

In this embodiment, there is provided a synthetic resinous outer sleeve 60 to facilitate the manual gripping of the device by a user and prevent slipping between the fingers of the user as the screw threading operation is started.

I wish it to be understood that I do not consider the invention limited to the precise details of structure shown and set forth in this specification, for obvious modifications will occur to those skilled in the art to which the invention pertains.

I claim:

1. An improved screw holding device for screwdrivers comprising: a unitary hollow tubular sleeve having a first proximal end and a second distal end; said sleeve including a cylindrical segment extending from said proximal end and terminating in a tapered portion, a cylindrical segment of reduced diameter extending distally from said tapered portion towards the distal end and terminating in a flared portion; and a third cylindrical portion of diameter corresponding to that of said first portion extending to said distal end; said cylindrical portion of reduced diameter having a plurality of elongated slots therein extending to said tapered and flared portions to form a plurality of parallel radially expandable resilient ribs.

2. In a combination screwdriver and screw holding device therefore, said screw holding device including a hollow tubular sleeve slidably disposed upon an elongated shank member of said screwdriver, the improvement comprising: said sleeve including: a unitary hollow tubular sleeve having a first proximal end and a second distal end; said sleeve including a cylindrical segment extending from said proximal end and terminating in a tapered portion, a cylindrical segment of reduced diameter extending distally from said tapered portion towards the distal end and terminating in a flared portion; and a third cylindrical portion of diameter corresponding to that of said first portion extending to said distal end; said cylindrical portion of reduced diameter having a plurality of elongated slots therein extending to said tapered and flared portions to form a plurality of parallel radially expandable resilient ribs; said first and third cylindrical portions having an internal diameter corresponding to the widest portion of said screwdriver shank, said second mentioned tubular portion of reduced diameter being resiliently expandable to permit movement over said widest portion of said screwdriver shank; and a screw having a threaded shank and a head portion at one end thereof, said shank having an outer diameter corresponding to the inner diameter of said elongated portion of reduced diameter whereby upon the introduction of said screw into the proximal end of said sleeve, said threaded shank of said screw may be positioned within said portion of reduced diameter to be supported in coaxial relationship therewith during the driving thereof by said screwdriver.

* * * * *